US011820618B2

(12) United States Patent
Aihara

(10) Patent No.: US 11,820,618 B2
(45) Date of Patent: Nov. 21, 2023

(54) SHEET CONVEYING APPARATUS, IMAGE READING APPARATUS, AND IMAGE FORMING APPARATUS

(71) Applicant: CANON KABUSHIKI KAISHA, Tokyo (JP)

(72) Inventor: Ryo Aihara, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 487 days.

(21) Appl. No.: 17/166,864

(22) Filed: Feb. 3, 2021

(65) Prior Publication Data

US 2021/0245978 A1 Aug. 12, 2021

(30) Foreign Application Priority Data

Feb. 7, 2020 (JP) ..... 2020-020196

(51) Int. Cl.
*B65H 3/06* (2006.01)
*G03G 15/00* (2006.01)
*B65H 5/06* (2006.01)

(52) U.S. Cl.
CPC ..... *B65H 3/0669* (2013.01); *B65H 3/0676* (2013.01); *B65H 3/0684* (2013.01); *B65H 5/062* (2013.01); *G03G 15/50* (2013.01); *G03G 15/6558* (2013.01); *B65H 2403/723* (2013.01);

(Continued)

(58) Field of Classification Search
CPC ..... B65H 3/06; B65H 3/0669; B65H 3/0684; B65H 2403/70; B65H 2403/72; B65H 2403/723; B65H 2403/724; B65H 2403/7241; B65H 2515/82; B65H 2601/521
See application file for complete search history.

(56) References Cited

U.S. PATENT DOCUMENTS

2007/0057433 A1* 3/2007 Lemura ..... B65H 3/06 271/109
2008/0023904 A1* 1/2008 Lee ..... B65H 3/06 271/117

(Continued)

FOREIGN PATENT DOCUMENTS

JP H11227952 A 8/1999

*Primary Examiner* — Prasad V Gokhale
(74) *Attorney, Agent, or Firm* — Canon U.S.A., Inc. I.P. Division

(57) ABSTRACT

A sheet conveying apparatus includes a transmitting mechanism-, a movable member, and a control portion to input a signal having first and second levels. The transmitting mechanism transmits driving force and includes a spring clutch and an electromagnetic clutch. The driving force pivotally moves the movable member. The spring clutch idles by a slackness of a spring when the rotation in a second direction is inputted to the transmitting mechanism and the movable member is regulated from pivoting at a predetermined position. The control portion inputs the signal to the transmitting mechanism such that the state electromagnetic clutch state changes the engagement state to the disengagement state through an intermediary state gradually varying a length of time where the signal of the first level is inputted into the electromagnetic clutch after the movable member reaches the predetermined position by inputting the rotation in the second direction to the transmitting mechanism.

11 Claims, 6 Drawing Sheets

(52) U.S. Cl.
CPC ..... *B65H 2403/724* (2013.01); *G03G 2215/00025* (2013.01); *G03G 2215/00556* (2013.01)

(56) References Cited

U.S. PATENT DOCUMENTS

| | | | | |
|---|---|---|---|---|
| 2013/0147107 | A1* | 6/2013 | Hanamoto | B65H 3/0669 271/18 |
| 2017/0359475 | A1* | 12/2017 | Xie | H04N 1/00628 |
| 2021/0221633 | A1* | 7/2021 | Kuroda | B65H 7/06 |

* cited by examiner (a)

(b)

(a)

(b)

SHEET CONVEYING APPARATUS, IMAGE READING APPARATUS, AND IMAGE FORMING APPARATUS

BACKGROUND

Field of the Invention and Related Art

The present invention relates to a sheet conveying apparatus for conveying documents which are in the form of a sheet of recording medium. It relates to also an image reading apparatus for obtaining information of an image of a sheet, and an image forming apparatus which forms an image on a sheet of recording medium.

Conventionally, some image reading apparatus, with which an image forming apparatus, such as a copying machine, a facsimileing machine, and a multifunction image forming machine, are provided with a sheet conveying apparatus which is referred to as an automatic sheet conveying apparatus (which hereafter will be referred to as ADF: Automatic Document Feeder). Some ADFs are provided with an electromagnetic clutch or the like to start or stop the transmission of driving force to their document conveyance unit.

Further, some sheet conveying apparatuses employ a spring clutch, as a mechanism for interrupting transmission of driving force from a motor as the spring of the spring clutch is subjected to no less than a preset amount of load. There is disclosed in Japanese Laid-open Patent Application No. H11-227952, a sheet conveying apparatus which is structured so that arms are pivotally moved by the driving force from its power source, with the placement of a spring clutch between the arms and power source. More specifically, it is provided with a stopper for regulating the arms in the range of their pivotal movement, so that as the arms come into contact with the stopper, the spring of the spring clutch is slackened by the contact. Therefore, the transmission of driving force from a motor (power source) is interrupted.

Regarding a sheet conveying apparatus which employs a driving system which uses a spring clutch, if the spring of its spring clutch remains slackened even after the motor is stopped, its driving system is continuously subjected to mechanical stress generated by the resiliency of the spring. However, if the spring clutch is disconnected from the driving system by the electromagnetic clutch, the force generated by the resiliency of the spring is released. However, if the force generated by the resiliency of the spring is released all at once, it sometimes occurs that as the spring clutch is disconnected from the driving system, the spring clutch, or the mechanical elements which are in the adjacencies of the spring clutch, are allowed to suddenly move, generating therefore collisional noises.

SUMMARY OF THE INVENTION

Thus, the primary object of the present invention is to provide a sheet conveying apparatus which is substantially less in the noises attributable to the spring of its spring clutch, than any conventional sheet conveying apparatus, and also, to provide an image forming apparatus equipped with a sheet conveying apparatus which is in accordance with the present invention.

According to an aspect of the present invention, there is provided a sheet conveying apparatus comprising: a transmitting mechanism configured to transmit driving force input from a driving force source, the transmitting mechanism including a spring clutch and an electromagnetic clutch capable of taking an engagement state transmitting the driving force and a disengagement state disconnecting the driving force; a pivotally movable member configured to be pivotally moved by the driving force transmitted through the transmission mechanism; a supporting portion configured to support a sheet; a feeding member, supported by the pivotally movable member, configured to feed the sheet supported by the supporting portion; a regulating portion configured to regulate the pivotally movable member from pivoting upward a predetermined position; and a control portion configured to control to input a signal, having a first level and a second level, varying the state of the electromagnetic clutch to the electromagnetic clutch, wherein in a case in which rotation in a first direction is inputted to the transmitting mechanism, the transmitting mechanism transmits the driving force to the pivotally movable member so as to rotate the pivotally moving member in a direction which the feeding member comes into contact with the sheet supported by the supporting portion, in a case in which the rotation in a second direction is inputted to the transmitting mechanism, the transmitting mechanism transmits the driving force to the pivotally movable member so as to rotate the pivotally moving member in a direction which the feeding member moves away from the sheet supported by the supporting portion and toward the predetermined potion, and in a case in which the rotation in the second direction is inputted to the transmitting mechanism and the pivotally movable member is regulated from pivoting by the regulating portion at the predetermined position, the spring clutch idles by a slackness of the spring, and wherein after the pivotally movable member reaches the predetermined position by inputting the rotation in the second direction to the transmitting mechanism, the control portion controls to input the signal to the transmitting mechanism such that the state of the electromagnetic clutch changes the engagement state to the disengagement state through an intermediary state gradually varying a length of time where the signal of the first level is inputted into the electromagnetic clutch.

Further features of the present invention will become apparent from the following description of exemplary embodiments (with reference to the attached drawings).

BRIEF DESCRIPTION OF THE DRAWINGS

Part (a) of FIG. 1 is a front view of the image forming apparatus in one of the preferred embodiments of the present invention, and Part (b) of FIG. 1 is a schematic view of the image formation engine of the image forming apparatus in Part (a) of FIG. 1.

Parts (a) and (b) of FIG. 2 are perspective and sectional views, respectively, of the image forming apparatus in Part (a) of FIG. 1.

Figure 5:
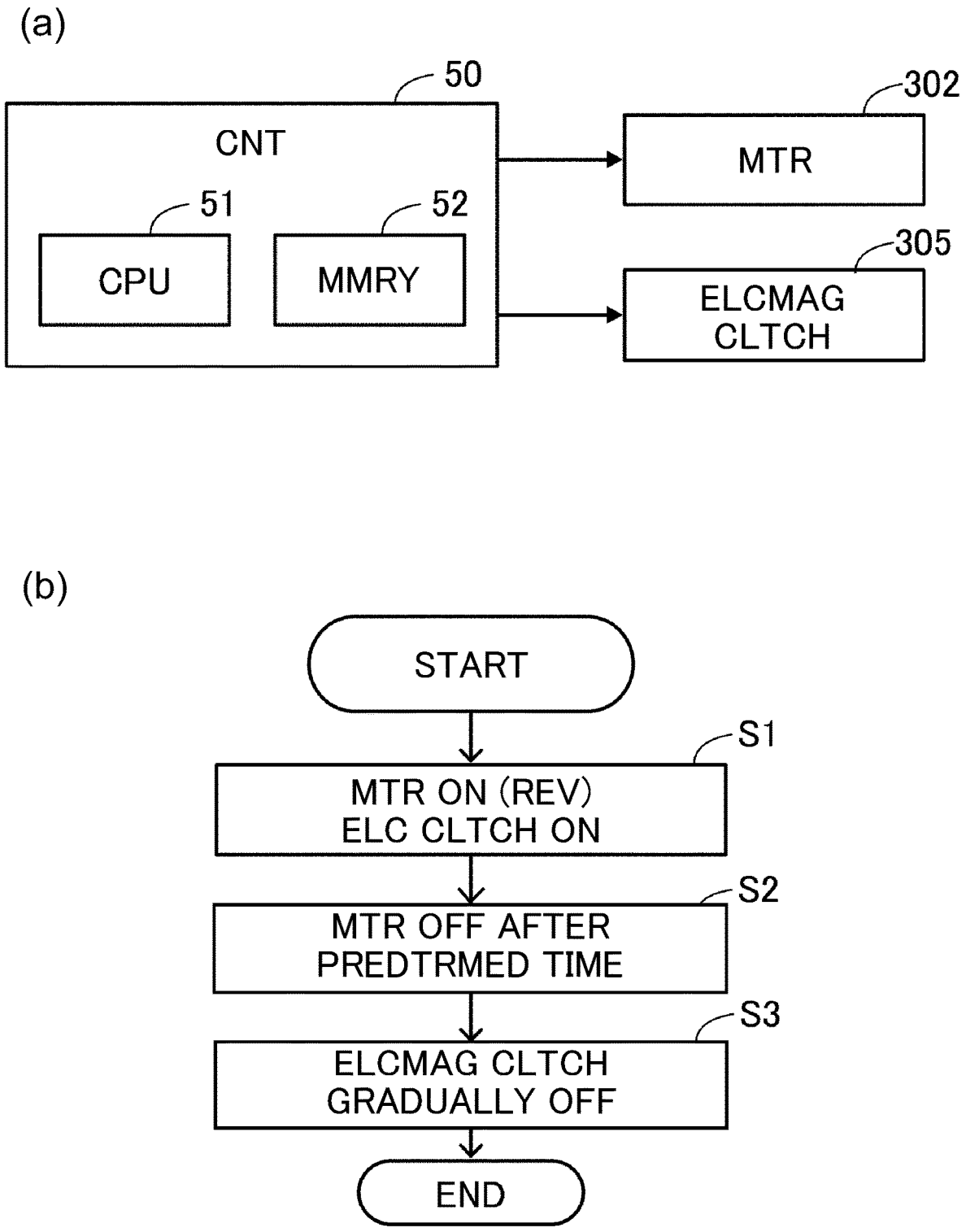

Part (a) of FIG. 5 is a block diagram of the control system of the image reading apparatus in the first embodiment, and Part (b) of FIG. 5 is a flowchart of the process to be carried out at the end of the sheet conveyance sequence.

Figure 6:
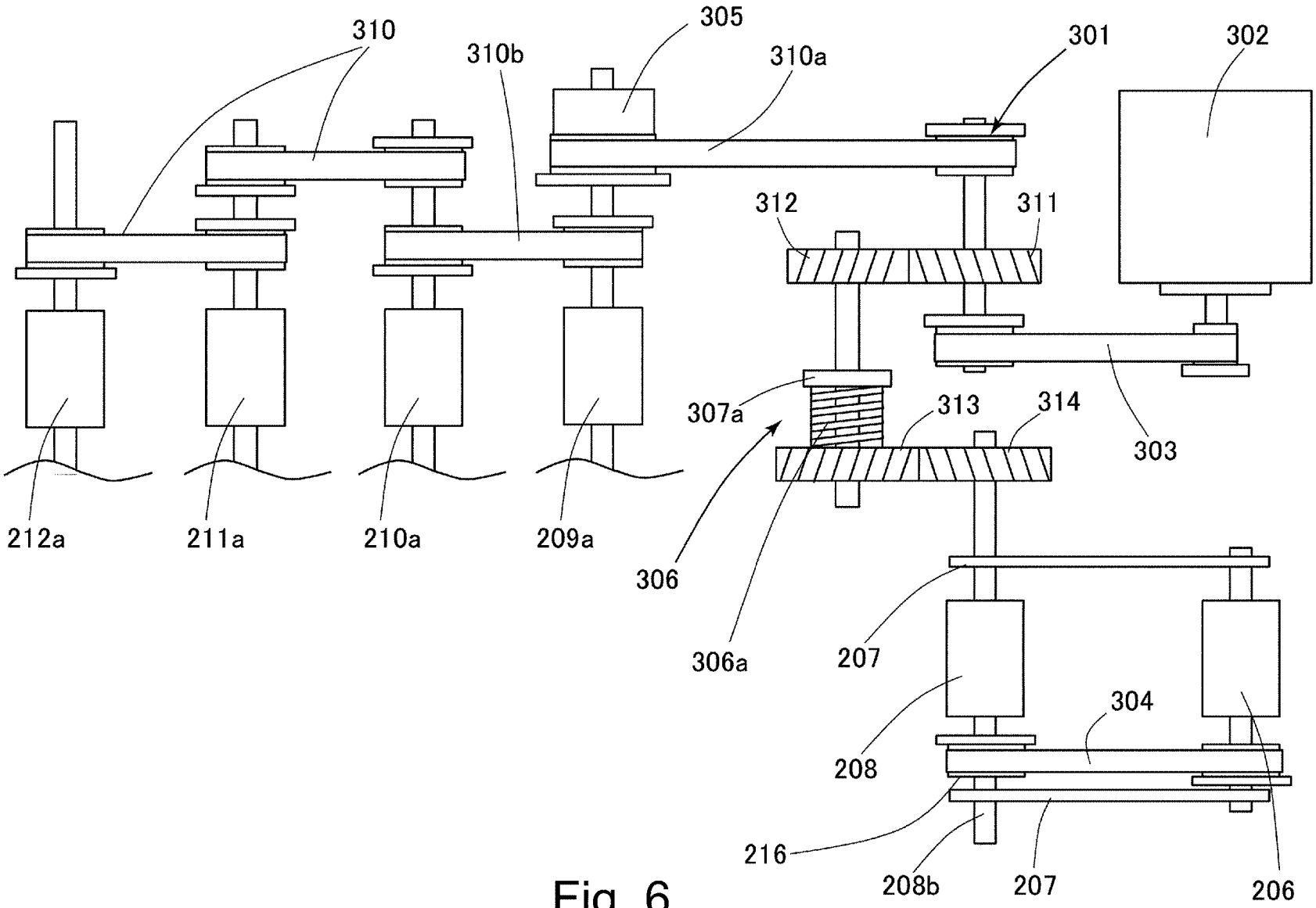

FIG. 6 is a schematic drawing of the driving system of the image reading apparatus in the second embodiment of the present invention.

DESCRIPTION OF THE EMBODIMENTS

Hereinafter, the present invention is described with reference to a few of the preferred embodiments of the present invention, along with appended drawings.

Figure 1:
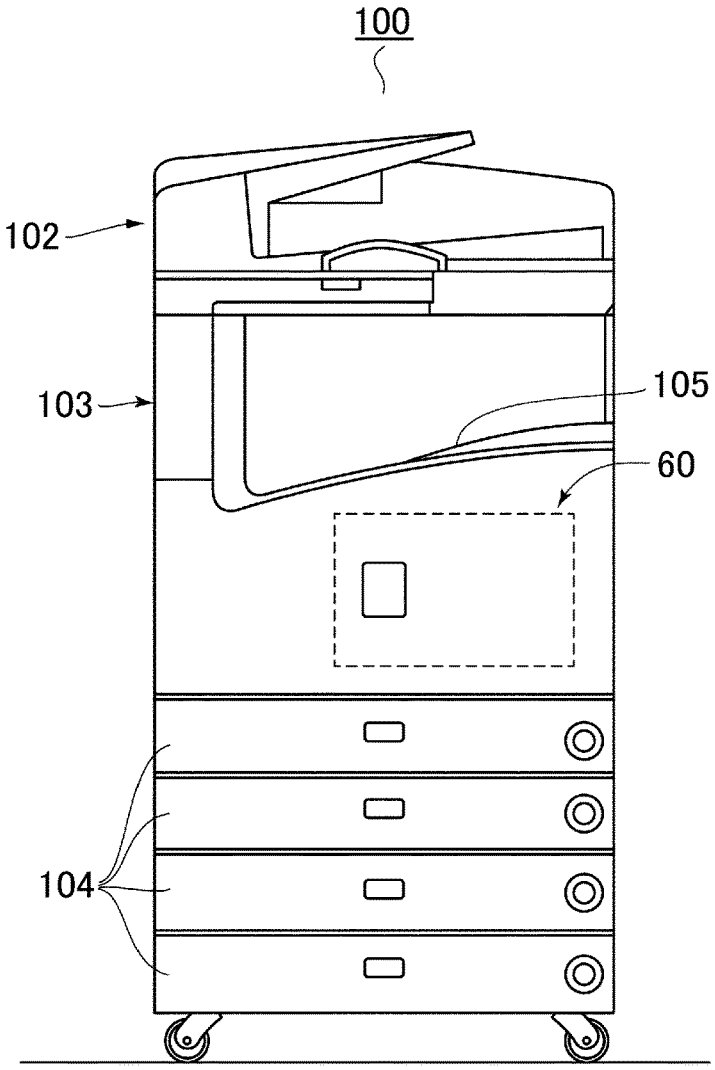
Figure 1:
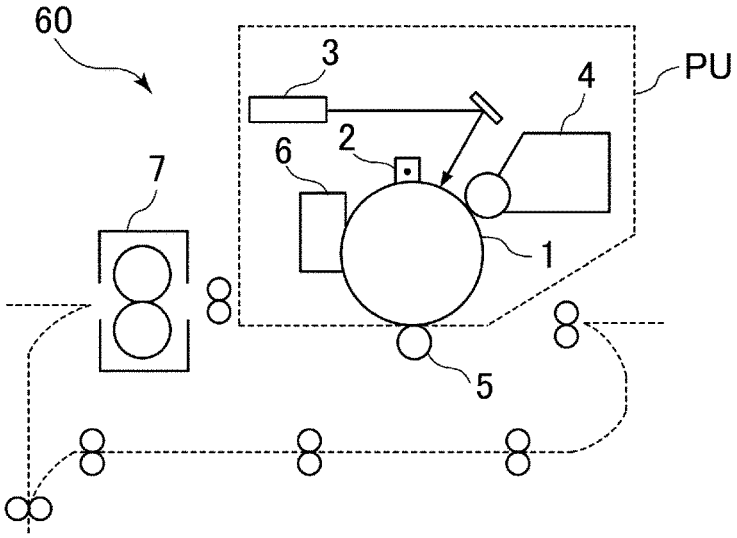

To begin with, referring to FIG. 1, the image forming apparatus in the first embodiment of the present invention is described about its general structure. FIG. 1(*a*) is a front view of an electrophotographic image forming apparatus 100 in this embodiment. FIG. 1(*b*) is a schematic drawing of the image formation engine, with which the image forming apparatus 100 is equipped.

[Image Forming Apparatus]

Referring to FIG. 1(*a*), the image forming apparatus 100 has: an image forming portion 103, which forms an image on a sheet of recording medium; and a recording medium cassette 104, which is mounted in the bottom portion of the image forming portion 103, and in which sheets of recording medium are stored in layers. The image forming apparatus 100 is provided with an image formation engine 60, as an image forming means, which is positioned in the roughly center portion of the image forming portion 103, when the image forming apparatus 100 is seen from the front side. Further, the image forming apparatus 100 has an image reading apparatus 102, which is mounted on the top side of the image forming portion 103 to read an original (to obtain information of image of original). Further, the image forming apparatus 100 is of the so-called inward discharge type. More specifically, it is provided with a delivery portion, which is between the image reading apparatus 102 and image forming portion 103, in terms of the top-bottom direction (vertical direction), and into which sheets of recording medium (originals) are discharged in layers after the formation of images on the sheets in the image forming portion 103.

Referring to FIG. 1(*b*), the image formation engine 60 comprises an electrophotographic image formation unit PU, and a fixing apparatus 7. As a command to start an image forming operation is issued, a photosensitive drum 1, as a photosensitive member (image bearing member), rotates, and the peripheral surface of the photosensitive drum 1 is uniformly charged by a charging apparatus 2. Then, an exposing apparatus 3 forms an electrostatic latent image by scanning the peripheral surface of the photosensitive drum 1, with the beam of laser light it outputs while modulating the beam in accordance with the information of the image to be formed, which is transmitted from the image reading apparatus 102 or an external computer. This electrostatic latent image is developed into an image formed of toner (turned into visible image) by the toner which is supplied from a developing apparatus 4.

In parallel to the progression of an image forming operation such as the one described above, an operation for conveying, one by one, sheets of recording medium in the recording medium cassette 104, or in the manual feeder tray, toward the image formation engine 60, is carried out. As each sheet of recording medium is conveyed in synchronism with the progression of the image forming operation, which is being carried out by the image formation unit PU. Then, the toner image on the peripheral surface of the photosensitive drum 1 is transferred onto a sheet of recording medium by a transfer roller 5. After the transfer of the toner image, the toner which is remaining on the peripheral surface of the photosensitive drum 1 is recovered by the cleaning apparatus 6. A sheet of recording medium, on which unfixed toner image has just been transferred, is moved to the fixing apparatus 7, in which the sheet is heated and pressed while remaining pinched by a pair of rollers. After the fixation (welding) of the toner image to the sheet P (after unfixed toner image melts and solidifies), the sheet is discharged into a delivery tray 105 of the main assembly of the image forming apparatus 100 by a discharging means such as a pair of discharge rollers.

The image formation engine 60 is an example of image forming means. An electrophotographic unit of the so-called intermediary transfer type, which transfers a toner image on the peripheral surface of a photosensitive member onto a sheet of recording medium by way of an intermediary transferring member such as an intermediary transfer belt, may be employed in place of the image formation engine 60. Further, the compatibility of the present invention is not limited to an electrophotographic image forming apparatus. It is compatible also to an image forming apparatus which uses such a printing mechanism as an inkjet type and offset type, as its image forming means.

[Image Reading Apparatus]

Figure 2:
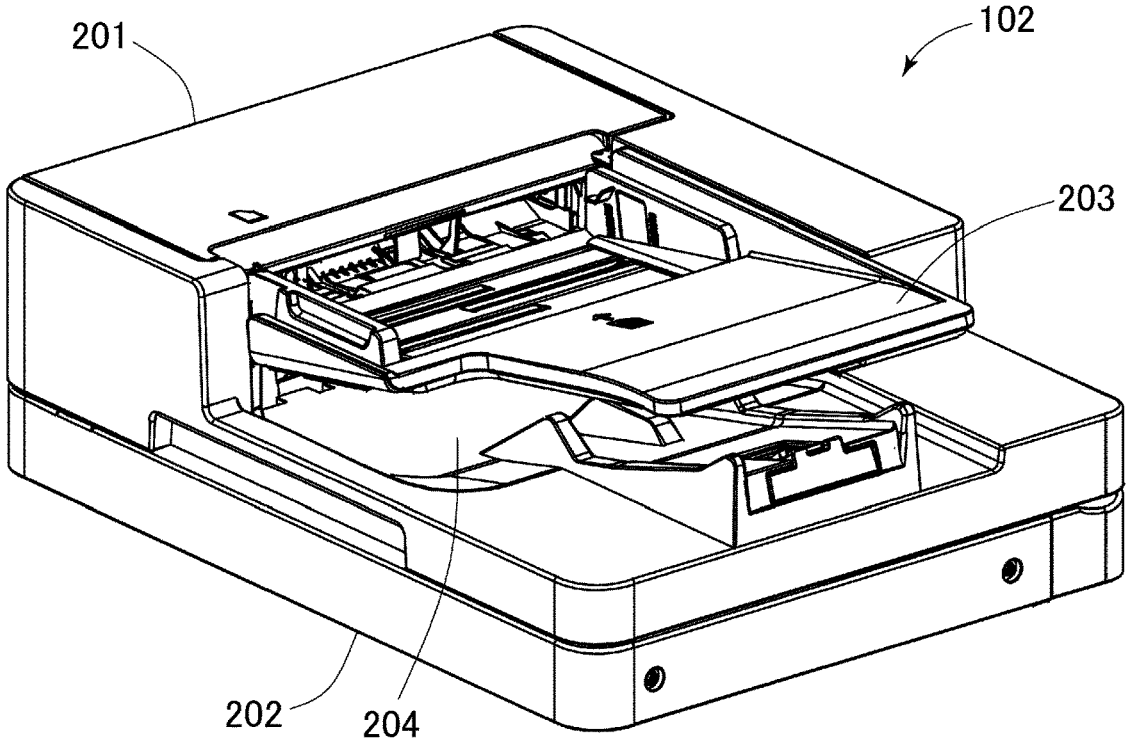
Figure 2:
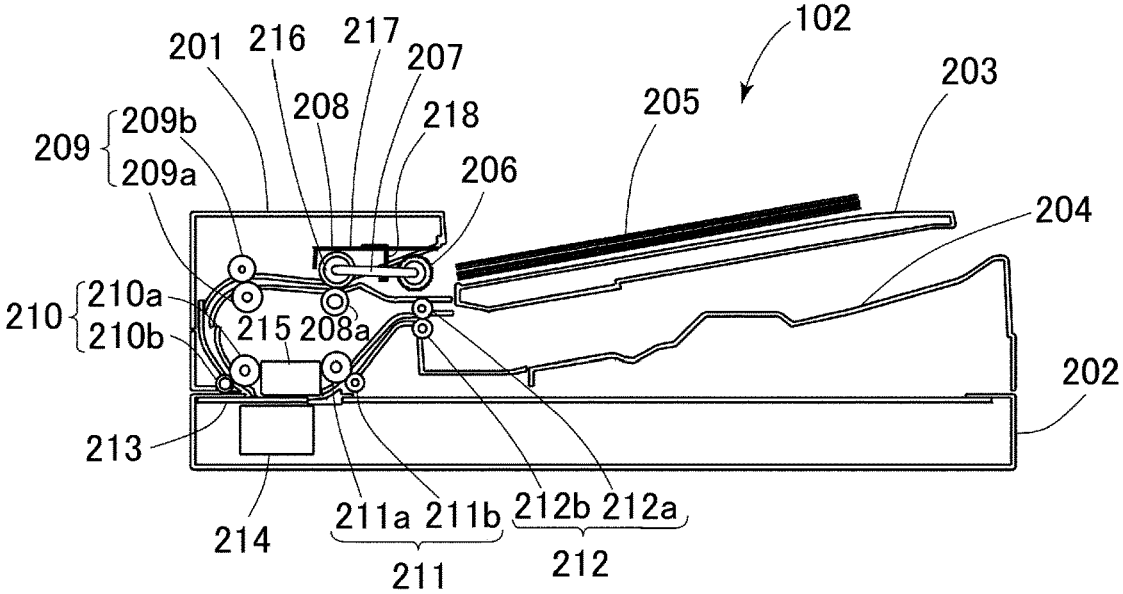

FIG. 2(*a*) is a perspective view of the image reading apparatus 102 in this embodiment. FIG. 2(*b*) is a sectional view of the image reading apparatus 102 in this embodiment. Referring to FIG. 2(*a*), the image reading apparatus 102 has an ADF 201 for reading the image of an original while feeding two or more originals (in the form of sheet) into its main assembly, one by one, and conveying each original. The ADF 201 is provided with a document feeder tray 203, which is a document supporting portion in which documents to be fed into the main assembly are held, and the delivery tray 204, into which the originals are discharged after the reading of the documents (obtaining of information of image of document). Further, image reading apparatus 102 has a main assembly 202, which is attached to one of the top edge portions of the image forming portion 103, in such a manner that it can be pivotally moved (opened or closed) relative to the main assembly of the image reading apparatus 102. The image reading apparatus 102 can read the image of an original while automatically feeding and conveying documents (originals), with the use of the ADF 201, and also, while keeping a document (original) stationary after a document is set on the top surface of the main assembly 202 by opening the ADF 201.

By the way, the originals (documents), and sheets of recording medium, on which an image of the original is formed, are different in size, shape, and material. For example, it may be ordinary paper, special paper such as coated paper. It may be in the form of an envelope and index card. Further, it may be plastic film for an overhead projector, or fabric.

Referring to FIG. 2(*b*), the ADF 201 is provided with a pickup roller 206 for feeding two or more layered originals in the document feeder tray 203, into the main assembly of the ADF 201 while separating them one by one. It is also provided with a separation roller 208. The pickup roller 206, which is a feeding roller, is positioned on the top side of the documents in the document feeder tray 203. It is rotatably supported by a pair of arms 207. The arms 207 are pivotally movable about a rotational shaft, roughly in the vertically direction. They make the pickup roller 206 come into contact with the top surface of the topmost document in the document feeder tray 203, by being made to downwardly pivot, or make the pickup roller 206 separate from the top surface of the topmost document in the door 20, by being made to upwardly pivot. The pickup roller 206 sends the documents in the document feeder tray 203, toward the separation roller 208 by rotating by being driven by a motor 302 (which will be described later), while it is in contact with the top surface of the topmost document in the document feeder tray 203.

The separation roller 208 is in contact with a friction roller 208*a*, which is an example of separating member. As the friction roller 208*a*, a roller which is supported by a shaft fixed to the frame of the ADF 201, with the placement of a torque limiter between the roller and shaft, a roller (retard roller) which receives driving force, which is opposite in direction from the document conveyance direction, by way of a torque limiter, can be employed. As two or more originals enter the nip (separation nip) between the separation roller 208 and friction roller 208*a*, the originals in the document feeder tray 203 other than the topmost one, which is in contact with the separation roller 208, are prevented by the friction between the originals and friction roller 208*a*, from being conveyed by the pickup roller 206. On the other hand, when only one original moves through the separation nip, the friction roller 208*a* is rotated by the rotation of the pickup roller 206, which is transmitted to the friction roller 208*a* by way of the topmost original. By the way, a friction pad may be employed in place of the friction roller 208*a*.

Further, the ADF 201 is provided with four pairs 209, 210, 211 and 212 of conveyance roller, which are positioned on the downstream side of the separation roller 208, in the listed order in the direction in which an original 205 is conveyed (along original conveyance passage in ADF 201, which hereafter will be referred to simply as conveyance direction). The four pairs 209-212 of conveyance rollers comprise drive rollers 209*a*, 210*a*, 211*a* and 212*a*, which are driven by a motor 302 (which will be described later), and follower (idler) rollers 209*b*, 210*b*, 211*b* and 212*b*, which are rotated by the driver rollers, respectively.

The conveyance passage through which originals are conveyed by the four pairs 209-212 of conveyance rollers has positions at which originals are scanned by image sensors 214 and 215 as reading means. As the image sensors 214 and 215, a contact image sensor (CIS) which has picture taking elements aligned in the primary scan direction, for example (widthwise direction of original, which is perpendicular to conveyance direction), and a lens array, which is a non-magnification optical system, can be used. However, an image sensor of the charge coupled device type, which uses a reduction optical system, may be used as the image sensors 214 and 215. The image sensor 214 is positioned in the main assembly 202. It obtains the information of the image of one (first surface) of the surfaces of an original while the original is conveyed along a glass platen 213 by the four pairs 202-212 of conveyance rollers. As for the image sensor 215, it is positioned in the ADF 201. It reads the other surface of the original. That is, it obtains the information of the image of the other surface (second surface) of the original while the original is conveyed by the four pairs 209-212 of conveyance rollers. After the original is moved along the image sensors 214 and 215, it is discharged into the delivery tray 204 by the pair 212 of conveyance rollers.

[Upward and Downward Pivotal Movement of Pickup Roller]

Referring to FIG. 2(*b*), the rotational shaft of the separation roller 208 is provided with a pressure applying means 216. The pressure applying means 216 is such a member that applies downward pressure to the arms 207 while the rotational shaft of the separation roller 208 rotates in the positive direction (direction in which the portion of peripheral surface of separation roller 208, which is in separation nip, moves is the same direction as original conveyance direction). As the ADF 201 begins an original conveyance sequence, the arms 207 are made to downwardly pivot by the pressure applying means 216. Thus, the pickup roller 206 is pressed upon the documents in the document feeder tray 203, by a preset amount of pressure, making it possible for the pickup roller 206 to convey originals.

As the original conveying sequence ends, the motor 302, which will be described later, rotates in reverse. Thus, the rotational shaft of the separation roller 208 is rotated in the opposite direction from the one in which it rotates during an original conveying sequence. During this period, the pressure applying means 216 applies upward force to the arms 207 to move the pickup roller 206 to the standby position for the pickup roller 206, which is higher than the position in which the pickup roller 206 is while conveying originals; it makes the pickup roller 206 separate from the document feeder tray 203.

As the pickup roller 206 rises to its standby position, the upward movement of the arms 207 and pickup roller 206 is stopped by a stopper 217. That is, the stopper 217, which is a regulating means, prevents the arms 207 from pivoting upward beyond a preset position. Further, the ADF 201 is provided with a holding means 218, which holds the arms 207 in the standby position. The holding means 218 may be an electromagnetic actuator such as a solenoid, a magnet which magnetically holds a magnet or a piece of iron plate, with which the arms 207 are provided, or a mechanical holding system. That is, all that is required of the holding means 218 is that it can hold the pickup roller 206 in the standby position when the motor 302 is off.

As the pressure applying means 216, a torque limiter, which can be placed between the rotational shaft of the separation roller 208, and arms 207, can be used. Moreover, a one-way clutch, which can be placed between the rotational shaft of the separation roller 208, and arms 207, may be used as the pressure applying means 216. Further, a combination of a one-way clutch and a torque limiter may be used. Further, a spring clutch may be used as the pressure applying means 216 to connect the rotational shaft of the separation roller 208 and arms 207.

In each of the cases mentioned above, when the rotational shaft of the separation roller 208 rotates in the reverse direction, the pressure applying means 216 causes the rotational shaft of the separation roller 208 to make the arms 207 upwardly pivot to the standby position. Further, it is preferable that the ADF 201 is structured so that the amount of torque, which the pressure applying means 216 can transmit to the arms 207 when the rotational shaft rotates in reverse is greater than that when the rotational shaft rotates in the positive direction. For example, a one-way clutch which is attachable in such a manner that the reverse direction of the rotational shaft is the same as the locking direction of the one-way clutch can be used as the pressure applying means 216.

Embodiment 1

[Drive Train]

Figure 3:
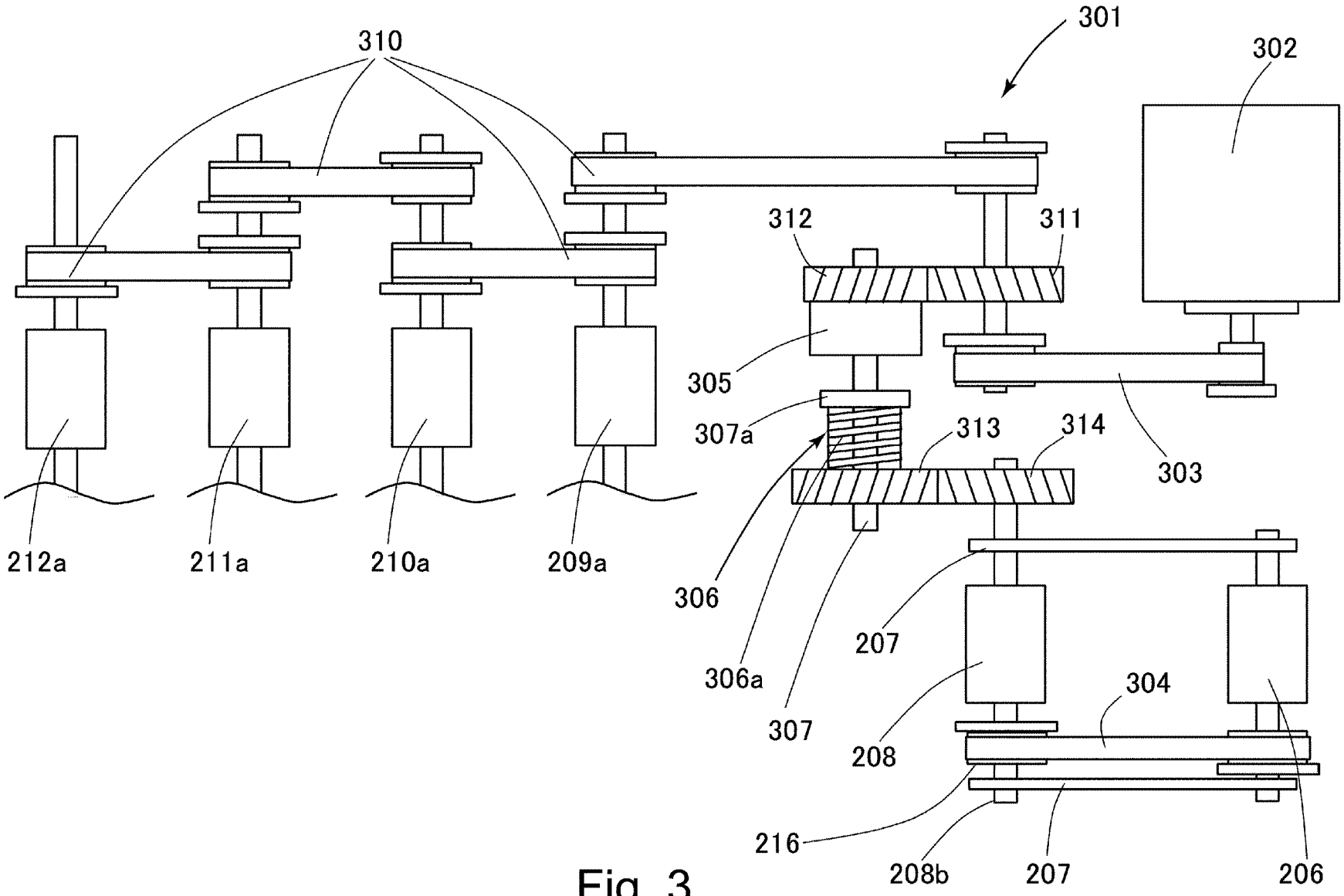
FIG. 3 is a schematic drawing of the driving system of the image reading apparatus in the first embodiment of the present invention.

Next, referring to FIG. 3, the ADF 201 is described about its drive train 301. "Drive train" means the entirety of such a mechanism that reacts to the driving force supplied by a single driving power source. It includes such loads (conveyance rollers, pivotal arms, etc.) of the mechanism, which are driven, and transmitting mechanism which transmits to each load, the driving force supplied from the driving force source. Referring to FIG. 3, the drive train 301 transmits the driving force which is supplied from the motor 302 as a driving force source, to each roller (206, 208, 209*a*, 210*a*, 211*a*, 212*a*) which are members to be driven, and arms 207 as a pivotally movable member. The drive train 301, which is the transmitting mechanism in this embodiment, includes three belts 303, 304 and 310, four gears 311, 312, 313 and 314, an electromagnetic clutch 305, and a spring clutch 306.

The electromagnetic clutch 306 and spring clutch 306 are positioned in the first transmission route, through which the driving force of the motor 302 is transmitted to a feeding unit (first portion to be driven) which comprises the pickup roller 206, separation roller 208, and arms 207. More concretely, the electromagnetic clutch 305 and spring clutch 306 are coaxially attached to the drive shaft 307.

The output shaft of the motor 302 is indirectly in connection to the input side of the electromagnetic clutch 305 by way of the belt 303 and gears 311 and 312. The output side of the electromagnetic clutch 305 is attached to the drive shaft 307. The spring clutch 306 is in connection to the gear 313, which is coaxially and rotatably fitted around the drive shaft 307. The gear 313 is in mesh with the gear 314, with which the rotational shaft 208*b* of the separation roller 208 is provided. The rotational shaft 208*b* of the separation roller 208 is fitted with the separation roller 208. Further, the rotational shaft 208*b* is indirectly in connection to the pickup roller 206 by way of the belt 304, and also, arms 207 by way of the pressure applying means 216 described above.

By the way, "connection of driving force transmission (driving force connection)" means that any two members on the driving force transmission route are directly or indirectly in connection to each other, and the driving force for causing an apparatus to carry out its inherent operation can be transmitted from one of the two members to the other. Further, "interruption of driving force transmission (disengagement)" means that the load which a portion to be driven bears can be prevented by the disengagement of clutch mechanism, for example, from affecting the driving force source.

Further, the drive train 301 has the second driving force transmission route, through which the driving force from the motor 302 is transmitted to the driving rollers 209*a*, 210*a*, 211*a* and 212*a*, as the second portions to be driven, of the aforementioned pairs 209, 210, 211 and 212 (FIG. 2(*b*)) of conveyance rollers. Each roller (209*a*-212*a*) is in connection to the output shaft of the motor 302 by way of the belts 310 and 303 described above. In other words, the second transmission route is a route through which a part of the driving force supplied from the motor 302, is distributed to the aforementioned rollers through the belts.

Next, the electromagnetic clutch 305 and spring clutch 306 are described in greater detail. When the electromagnetic clutch 305 is in engagement (connected), a part of the driving force from the motor 302 is inputted to the spring clutch 306 by way of the drive shaft 307. When the electromagnetic clutch 305 is in disconnect (disengaged), the drive shaft 307 remains disconnected from the driving force source of the drive train 301. Therefore, the driving force from the motor 302 is not inputted into the spring clutch 306.

The spring clutch 306 has a spring 306*a*, which is a torsional coil spring positioned compressed between the plate 307*a*, with which the drive shaft 307 is provided, and the gear 313, for example. One end of the spring 306*a* is fixed to either the drive shaft 307 or gear 313, whereas the other end is positioned in contact with either the drive shaft 307 or gear 313 in such a manner that it is allowed to slip on the drive shaft 307 or gear 313. Further, the spring 306*a* is attached to the peripheral surface of the cylindrical portion of the drive shaft 307 or the gear 313 in such a manner that it was wound around the cylindrical portion.

Moreover, the ADF 201 is structured so that as the motor 302 rotates in the positive direction, the spring 306*a* tightens around the aforementioned cylindrical portion, whereas as the motor 302 rotates in reverse, it slackens (increases in internal diameter), in such a manner that as the load to which it is subjected exceeds a preset amount, it does not rotate or idles with the cylindrical portion. However, "rotation of the motor 302 in the positive direction" means such rotation of the motor 302 that causes the pickup roller 206 and separation roller 208 to convey originals. "Reverse rotation of the motor 302 means the opposite rotation of the motor 302 from the one in which the motor 302 rotates to cause the pickup roller 206 and separation roller 208 to convey originals.

In other words, as the motor 302 rotates in the positive direction, the spring 306*a* tightens, increasing thereby its grip on the cylindrical portion, putting itself in the first state in which it can transmit torque as long as the torque is no more than the first value. On the other hand, as the motor 302 rotates in reverse, that is, in the second direction which is opposite from the first direction (direction in which drive shaft 307 rotates during reverse rotation of motor), the spring 306 slackens, putting itself in the second state in which it can transmit such torque that is no more in value than the second torque which is smaller in value than the first torque. If the output side of the spring clutch 306 is subjected to such load that is greater in value than the second torque while rotational force, which is in the second direction, is inputted into the spring clutch 306, the spring 306*a* slackens, being thereby allowed to slip on the drive shaft 307 or gear 313. Thus, the spring clutch 306 does not transmit rotational force.

[Action of Drive Train 301 During Original Conveyance]

Described next is the action of the drive train 301, which occurs when the ADF 201 conveys documents. The pickup roller 206 and separation roller 208 in this embodiment can be changed in the state of operation, between the one in which they rotate and the one in which they remain stationary, by electrically controlling (engaging or disengaging) the electromagnetic clutch 305, even if the motor 302 is rotating. Therefore, the ADF 201 can be controlled in original conveyance interval, by controlling the electromagnetic clutch 305, even when its pickup roller 206 is kept in the feeding position.

More concretely, as an original conveyance sequence is started in response to the command from a user, the control portion 50 (FIG. 5(*a*)) which controls the ADF 201 in operation, engages (ON) the electromagnetic clutch 305, and rotates the motor 302 in the positive direction. As a result, the rotational shaft 208*b* of the separation roller 208 rotates in the positive direction. Thus, the arms 207 are made to downwardly pivot, by the pressure applying means 216, causing thereby the pickup roller 206 to come into contact with the topmost original. Further, as the rotational shaft 208*b* rotates in the positive direction, the pickup roller 206 and separation roller 208 also rotate. Therefore, the topmost original is fed into the main assembly of the ADF 201.

As soon as the leading edge (downstream edge in terms of conveyance direction) of the topmost original reaches the most upstream pair 209 of conveyance rollers, the electromagnetic clutch 305 is disengaged (OFF), and therefore, the driving of pickup roller 206 and separation roller 208 stop rotating. However, the original is conveyed to the scanning positions of the image sensors 214 and 215 (FIG. 2(*b*)), through the internal conveyance passage of the ADF 201, by the pairs 209-212 of conveyance rollers, which are being driven by the motor 302 which is rotating in the positive direction. By the way, even after the disengagement of the electromagnetic clutch 305, the pickup roller 206 remains in its conveyance position. The pickup roller 206 and separation roller 208 continue to idle while the topmost original is conveyed by the pairs 209-212 of conveyance rollers. Then, they stop rotating as soon as the trailing edge of the topmost original passes.

Thereafter, the control portion 50 determines the timing with which the next original is to be fed into the main assembly of the ADF 201, based on the result of detection by the sensors, with which the original conveyance passage is provided. As the control portion 50 determines that it is the timing to start the feeding of the next original, it re-engages the electromagnetic clutch 305. Thus, the rotation of the pickup roller 206 and separation roller 208 restarts. Therefore, the next original is fed into the main assembly of the ADF 201. Thereafter, as soon as the leading edge of the original which is being conveyed, reaches the most upstream pair 209 of conveyance rollers, the electromagnetic clutch 305 is disengaged. As described above, in this embodiment, two or more originals can be sequentially fed into the main assembly of the ADF 201 with a desired interval, by repeatedly engaging, and then, disengaging the electromagnetic clutch 305 while the motor 302 is continuously rotated.

[Action of Spring Clutch, which Occurs at End of Conveyance Sequence]

During an original conveyance sequence, the motor 302 continuously rotates in the positive direction. Further, as the electromagnetic clutch 305 is engaged, the driving force from the motor 302 acts in the direction to make the spring clutch 306 tighten, preventing the spring clutch 306 from slipping. Therefore, the driving force from the motor 302 is transmitted to the pickup roller 206 and separation roller 208.

On the other hand, as the original conveyance sequence ends, the arms 207 are made to upwardly pivot, by way of the pressure applying means 216, by rotating the motor 302 in reverse, as described above. As the pickup roller 206 moves upward to its standby position, the arms 207 come into contact with the stopper 217. Consequently, the load to which the spring clutch 306 is subjected suddenly increases. Thus, the spring 306*a* slackens, and therefore, spring 306*a* slips. That is, the connection between the motor 302 and arms 207 is broken by the spring clutch 306. Therefore, the arms 207 do not pivotally move upward any higher. Further, the arms 207 are held by the holding means 218. Therefore, the pickup roller 206 remains in its standby position, against the downward force to which the arms 207 is subjected by the resiliency of the spring 306*a*.

If the motor 302 is stopped while the spring clutch 306 is remaining disengaged, the drive train 301 is subjected to such torque that acts in the direction to tighten the spring clutch 306, by the resiliency of the spring 306*a*. In a case where the ADF 201 is structured so that the amount of torque necessary to activate the drive train 301 while the drive train 301 is remaining stationary, is greater than the torque generated by the resiliency of the spring 306*a* of the spring clutch 306, the drive shaft 307 of the spring clutch 306 cannot rotate. Therefore, the spring 306*a* remains slackened. In this case, the stopper 207 and holding means 218 which regulate the arms 207 in position, and drive train 301, are subjected to the mechanical stress attributable to the resiliency of the spring 306*a*. This type of stress possibly results in the deformation (creep deformation, or the like) of the aforementioned members, and/or operational interferences, such that components pop up during the maintenance of the ADF 201. Therefore, it is undesirable.

As long as the electromagnetic clutch 305 is disengaged (OFF) after the stopping of the motor 302, the force generated by the resiliency of the spring 306*a* is released. However, if the electromagnetic clutch 305 is abruptly disengaged, it is possible that the spring clutch 306, and the mechanical elements in the adjacencies of the spring clutch 306 will suddenly rotate, which will result in the generation of collisional noises. By the way, "suddenly disengaging the electromagnetic clutch 305" means to suddenly reduce the electric current, which is being flowed to keep the electromagnetic clutch 305 engaged, in value, from the preset one (rated one, if it was rated) to zero in the pattern of rectangular waveform.

In this embodiment, therefore, the electromagnetic clutch 305, which is a disengaging means, is gradually changed in the state of engagement from the one in which the electromagnetic clutch 305 is in full engagement, to the one in which it remains completely disengaged, after the stopping of the motor 302. "Gradually" means to change the disengaging means in the state of engagement, from the one in which it is in full engagement, to the one in which it is in complete disengagement, by way of an intermediary state between the two states described above, regardless of whether the change is made in steps, or continuously. The "intermediary state" means such a state that the state of engagement of the electromagnetic clutch 305 is weaker than the state of connection between the input and output sides of the drive train 301.

Figure 4:
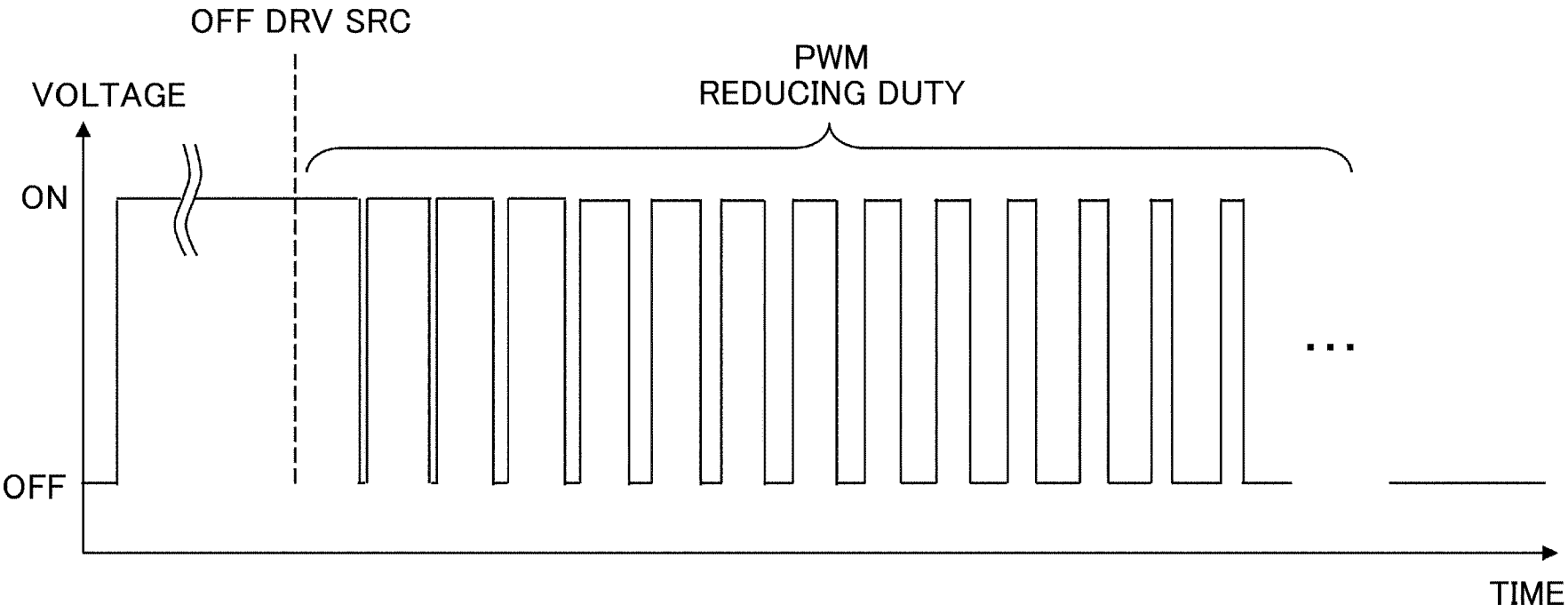
FIG. 4 is a drawing of the waveform of the voltage which is inputted into the electromagnetic clutch in the first embodiment.

In this embodiment, the electromagnetic clutch 305 is gradually changed in the state of engagement, from the one in which the electromagnetic clutch 305 is in full engagement, to the one in which the electromagnetic clutch 305 is in complete disengagement, by inputting into the electromagnetic clutch 305, such voltage that changes in magnitude with the elapse of time, with the use of PWM (Pulse Width Modulation) such as the one shown in FIG. 4. That is, the voltage which is being supplied to the electromagnetic clutch 305 is given such a waveform that gradually reduced in duty ratio from the first level, that is, 100%, at which the electromagnetic clutch 305 is in full engagement, to the second level, that is, 0% (voltage is gradually reduced in the length of time it is kept on). In a case where the voltage is changed in duty ratio with 10% interval, the period in which duty ratio is in a range of 90%-10% is correspondent to the intermediary state in this embodiment.

FIG. 5(*a*) is a block diagram of the control system in this embodiment. The control portion 50, as the means for controlling the ADF 201 in operation, has a central processing unit 51 (CPU), and a memory 52. The CPU 51 reads the programs in the memory 52, and carries out the programs to control the motor 302 and electromagnetic clutch 305 of the ADF 201, and other actuators. The memory 52 includes a nonvolatile storage area such as a read-only memory (ROM), and a volatile storage area such as a random access memory (RAM). Not only does it serve as a place in which programs and data are held, but also, as an operational space for the CPU 51 to use to carry out the programs. The memory 52 is an example of non-transient memory, in which the programs for controlling an image reading apparatus are stored, and which can be read by a computer. By the way, the control portion 50 may be placed in other casing (main assembly 202, for example) than the casing of the ADF 201.

FIG. 5(*b*) shows the control sequence to be carried out at the end of the original conveyance sequence. At the end of an original conveyance sequence, the control portion 50 makes the arms 207 upwardly pivot by reversely rotating the motor 302 while keeping the electromagnetic clutch 305 engaged (S1). After the elapse of a preset length time, the control portion 50 stops driving the motor 302 (S2). The preset length of time is the sum of the estimated length of time from the starting of the reversal rotation of the motor 302 to when the arms 207 come into contact with the stopper 217, and the length of time which is necessary to assure that the arms 207 come into contact with the stopper 217. Thereafter, the control portion 50 gradually changes the electromagnetic clutch 305 in the state of engagement, from the one in which the electromagnetic clutch 305 is in full engagement (ON), to the one in which the electromagnetic clutch 305 is in complete disengagement (OFF), with the use of the above-described PWM control (S3).

With the use of PWM control such as the one described above, the force generated by the resiliency of the slackened spring 306*a* is gradually released. Therefore, the collisional noises are unlikely to occur. That is, at a certain point in time in the period in which the electromagnetic clutch 305 is changed in the state of engagement from the one in which it is full engagement, to the one in which it is in complete disengagement, with the use of PWM control, the amount of magnetic force generated by the electric magnet of the electromagnetic clutch 305 becomes less than the mechanical force generated by the resiliency of the spring 306*a* of the spring clutch 306, and therefore, the spring clutch 306 begins to return to the neutral state. At this point in time, however, the difference between the force generated by the electric magnet 305*a* of the electromagnetic clutch 305 and the force generated by the resiliency of the spring 306*a* of the spring clutch 306 is very small. Therefore, the spring clutch 306 remains gentle in reaction. Even thereafter, the force generated by the electric magnet of the electromagnetic clutch 305 continues to retard the reaction of the spring clutch 306. Therefore, the spring clutch 306 and the mechanical elements in the adjacencies of the spring clutch 306 are unlikely to generate collisional noises.

By the way, from the standpoint of ensuring to prevent the occurrence of the collisional noises, the length of time the voltage, which is being supplied to the electromagnetic clutch 305, is kept in a range of 90%-10%, is desired to be longer (three times, for example, preferably, no less than 10 times) than the time constant which indicates the speed at which the excitation current of the electromagnetic clutch 305 starts up.

Further, in this embodiment, the electromagnetic clutch 305 was used as a disengaging means. However, a clutch other than the electromagnetic clutch 305 can be used as a disengaging means. For example, a frictional clutch or the like can be used.

Embodiment 2

Next, referring to FIG. 6, the second embodiment of the present invention is described. In the first embodiment described above, the electromagnetic clutch 305, which was used as a disengaging means, was coaxially positioned next to the spring clutch 306, in the drive train 301. However, it may be positioned in other position than the one in the first embodiment, in the drive train 301.

In this embodiment, as an example of setup in which a disengaging means is placed in the different driving force transmission route (second driving force transmission route) from the one in which the spring clutch 306 is placed, in the drive train 301, the electromagnetic clutch 305 is placed in the driving force transmission route to the drive rollers 209*a*-212*a* of the pairs 209-212 of conveyance roller. More concretely, as the electromagnetic clutch 305 is disengaged, the torque necessary to start rotating the pairs 209, 210, 211 and 212 of conveyance rollers stop affecting the spring clutch 306. Therefore, while the motor 302 is remaining stationary, if the electromagnetic clutch 305 is in engagement, the spring 305*a* of the spring clutch 306 remains slackened. However, as the electromagnetic clutch 305 is disengaged, it becomes possible for the spring clutch 306 to change in state of engagement, from the one in which it remains slackened, to the one in which it remain neutral.

In such a case, the spring clutch 306, and the mechanical elements in the adjacencies of the spring clutch 306, can be prevented from generating collisional noises when the electromagnetic clutch 305 is disengaged at the end of an original conveyance sequence, with the use of PWM, that is, giving the voltage to be inputted into the electromagnetic clutch 305, such a waveform as the one shown in FIG. 4, as in the first embodiment.

This embodiment is not intended to limit the present invention in scope in terms of where in the driving force transmission route the electromagnetic clutch 305 is to be placed. All that is necessary is that the electromagnetic clutch 305 is placed between the shaft, around which the spring clutch 306 is fitted, and the drive train 301 which generates load (friction) which is greater than the torque generated by the resiliency of the spring 306*a* of the spring clutch 306.

Another Embodiment

In the preceding embodiments, the original feeding apparatus was an ADF (ADF 201) attachable to an image forming apparatus. However, the present invention is also applicable to other sheet (document) conveying apparatus. For example, the present invention is also applicable to a sheet conveying apparatus (feeding apparatus) which conveys a sheet of paper, which is used as recording medium by an image forming apparatus.

[Miscellanies]

The present invention can be realized by such a process that supplies programs which can realize one or more functions of the ADF 201 in the embodiments described above, to system or an apparatus by way of a network or a storage medium, and one or more processors of the system or apparatus read the program. Further, the present invention can also be realized by a circuit (ASIC, for example) which realizes no less than one function.

Further, the application of this technology is not limited to a sheet conveying apparatus employable by an image forming apparatus or image reading apparatus. That is, the present invention is also applicable to various machines, for example, automobiles, industrial machines, etc.

This application claims the benefit of Japanese Patent Application No. 2020-020196 filed on Feb. 7, 2020, which is hereby incorporated by reference herein in its entirety.

What is claimed is:

1. A sheet conveying apparatus comprising:

a transmitting mechanism configured to transmit driving force input from a driving source, wherein the transmitting mechanism includes a spring clutch and an electromagnetic clutch, wherein the electromagnetic clutch is capable of taking an engagement state transmitting the driving force and a disengagement state disconnecting the driving force;

a pivotally movable member configured to be pivotally moved by the driving force transmitted through the transmitting mechanism;

a supporting portion configured to support a sheet;

a feeding, member supported by the pivotally movable, member and configured to feed the sheet supported by the supporting portion;

a regulating portion configured to regulate the pivotally movable from pivoting upward a predetermined position; and a control portion configured to control to input a signal, having a first level and a second level, varying the state of the electromagnetic clutch to the electromagnetic clutch, wherein, in a case in which rotation in a first direction is inputted to the transmitting mechanism, the transmitting mechanism transmits the driving force to the pivotally movable so as to rotate the pivotally movable member in a direction in which the feeding member comes into contact with the sheet supported by the supporting portion, wherein, in a case in which rotation in a second direction is inputted to the transmitting mechanism, the transmitting mechanism transmits the driving force to the pivotally movable so as to rotate the pivotally movable member in a direction in direction which the feeding member moves away from the sheet supported by the supporting portion and moves toward the predetermined position, wherein, in a case in which the rotation in the second direction is inputted to the transmitting mechanism and the pivotally movable is regulated from pivoting by the regulating portion at the predetermined position, a spring clutch idles by a slackness of a spring, and wherein, after the pivotally movable reaches the predetermined position by inputting the rotation in the second direction to the transmitting mechanism, the control portion controls to input the signal to the transmitting mechanism such that the state of the electromagnetic clutch changes the engagement state to the disengagement state through an intermediary state having a length of time gradually varying the length of time where the signal of the first level is inputted into the electromagnetic clutch.

2. The sheet conveying apparatus according to claim 1, wherein the length of time in the intermediary state is longer than a time constant of a coil of the electromagnetic clutch when input of the signal to the coil is stopped.

3. The sheet conveying apparatus according to claim 1, wherein the electromagnetic clutch is provided on a transmission route transmitting the driving force of the driving source through the spring clutch.

4. The sheet conveying apparatus according to claim 3, wherein the electromagnetic clutch is provided coaxially with the spring clutch.

5. The sheet conveying apparatus according to claim 1, wherein the transmitting mechanism includes a first transmission route which transmits the driving force of the driving source to the pivotally movable through the spring clutch, and a second transmission route which transmits the driving force of the driving source to a driven portion, different from the pivotally movable, without passing through the spring clutch.

6. The sheet conveying apparatus according to claim 1, wherein, in a case in which the rotation in the second direction is inputted to the transmitting mechanism until the spring clutch idles, the slackness of the spring of the spring clutch remains while the electromagnetic clutch is in the engagement state, and the slackness of the spring restores when the electromagnetic clutch changes in the disengagement state.

7. The sheet conveying apparatus according to claim 1, wherein the feeding member includes a feed roller, wherein the feed roller is supported by the pivotally movable, member and is configured to feed the sheet by being rotated by the driving force transmitted through the spring clutch.

8. The sheet conveying apparatus according to claim 1, wherein the signal of the first level is transmitted to the electromagnetic clutch, and wherein the control portion is configured to alternately input the signal of the first level and the signal of the second level to the electromagnetic clutch in the intermediary state, and is configured to gradually reduce the length of time where the signal of the first level is inputted.

9. The sheet conveying apparatus according to claim 1 wherein the control portion is configured to vary a width of the signal by pulse width modulation (PWM) so that the electromagnetic clutch is in the intermediary state.

10. An image reading apparatus comprising:

a sheet conveying apparatus having:

a transmitting mechanism configured to transmit driving force input from a driving source, wherein the transmitting mechanism includes a spring clutch and an electromagnetic clutch, wherein the electromagnetic clutch is capable of taking an engagement state transmitting the driving force and a disengagement state disconnecting the driving force, a pivotally movable configured to be pivotally moved by the driving force transmitted through the transmitting mechanism, a supporting portion configured to support a first sheet, a feeding member supported by the pivotally movable and configured to feed the first sheet supported by the supporting portion, a regulating portion configured to regulate the pivotally movable from pivoting upward a predetermined position, and a control portion configured to control to input a signal, having a first level and a second level, varying the state of the electromagnetic clutch to the electromagnetic clutch, wherein, in a case in which rotation in a first direction is inputted to the transmitting mechanism, the transmitting mechanism transmits the driving force to the pivotally movable so as to rotate the pivotally movable in a direction in which the feeding member comes into contact with the first sheet supported by the supporting portion, wherein, in a case in which rotation in a second direction is inputted to the transmitting mechanism, the transmitting mechanism transmits the driving force to the pivotally movable so as to rotate the pivotally movable in a direction in which the feeding member moves away from the first sheet supported by the supporting portion and moves toward the predetermined position, wherein, in a case in which the rotation in the second direction is inputted to the transmitting mechanism and the pivotally movable is regulated from pivoting by the regulating portion at the predetermined position, a spring clutch idles by a slackness of a spring, and wherein, after the pivotally movable reaches the predetermined position by inputting the rotation in the second direction to the transmitting mechanism, the control portion controls to input the signal to the transmitting mechanism such that the state of the electromagnetic clutch changes the engagement state to the disengagement state through an intermediary state having a length of time gradually varying the length of time where the signal of the first level is inputted into the electromagnetic clutch; and an image reading portion configured to read an information of an image from the first sheet fed by the feeding member.

11. An image forming apparatus comprising:

the image reading apparatus according to claim 10; and an image forming, portion configured to form an image on a second sheet based on the information read from the first sheet by the image reading.

* * * * *